US005381916A

United States Patent [19]

Strawder

[11] Patent Number: 5,381,916

[45] Date of Patent: Jan. 17, 1995

[54] MODULAR RECEPTACLES

[76] Inventor: Glenn G. Strawder, 9200 Edwards Way, #1116, Adelphi, Md. 20783

[21] Appl. No.: 947,844

[22] Filed: Sep. 21, 1992

Related U.S. Application Data

[63] Continuation-in-part of Ser. No. 757,186, Sep. 10, 1991, abandoned, which is a continuation-in-part of Ser. No. 501,950, Mar. 28, 1990, Pat. No. 5,050,755.

[51] Int. Cl.[6] ..... B65D 21/02

[52] U.S. Cl. ..... 220/23.4; 220/23.83; 220/212; 220/212.5; 220/752; 220/771; 220/909

[58] Field of Search ..... 220/23.2, 23.4, 23.83, 220/352, 909

[56] References Cited

U.S. PATENT DOCUMENTS

| | | | |
|---|---|---|---|
| 2,773,624 | 12/1956 | Knieriem et al. | 220/DIG. 15 X |
| 3,194,426 | 7/1965 | Brown, Jr. | 220/23.4 |
| 3,307,729 | 3/1967 | Schwartz | 220/23.4 X |
| 3,763,980 | 10/1973 | Vom Stein et al. | 220/23.4 X |
| 3,815,281 | 6/1974 | Kander | 206/808 X |
| 4,133,445 | 1/1979 | Mandelbaum | 220/23.4 |
| 4,889,254 | 12/1989 | Vola | 220/23.4 |
| 4,966,298 | 10/1990 | Von Holdt | 220/23.4 |

FOREIGN PATENT DOCUMENTS

| | | | |
|---|---|---|---|
| 1323774 | 3/1963 | France | 220/23.4 |
| 2434089 | 1/1976 | Germany | 220/23.4 |
| 2713543 | 10/1978 | Germany | 220/23.4 |
| 3306348 | 8/1984 | Germany | 220/23.4 |
| 451802 | 5/1968 | Switzerland | 220/23.4 |
| 1539870 | 2/1979 | United Kingdom | 220/23.4 |

*Primary Examiner*—Gary E. Elkins
*Assistant Examiner*—Stephen Cronin
*Attorney, Agent, or Firm*—William D. Hall

[57] ABSTRACT

A plurality of receptacles, each having a bottom, and each having a sidewall that terminates at a rim. Each receptacle also has a side that has a projection, and at least one side that defines an indent. The indented sidewall of one receptacle will receive the projection on the other receptacle interconnecting them. Each receptacle handle projects into a slot in another receptacle when the receptacles are interconnected with each other. Tops or lids with the same configuration as the receptacle, cover the top area.

14 Claims, 4 Drawing Sheets

MODULAR RECEPTACLES

RELATED APPLICATION

This application is a continuation-in-part of my prior copending application Ser. No. 757,186 filed Sep. 10, 1991 and entitled Modular Receptacle, now abandoned which application is a continuation-in-part of my application Ser. No. 07/501,950, filed Mar. 28, 1990, now U.S. Pat. No. 5,050,755 granted Sep. 24, 1991.

BACKGROUND OF THE INVENTION

The prior art includes a number of patents teaching modular units held together with tongue and groove joints in which each tongue tapers to a larger size as the distance from the side of unit increases and the groove gets wider as its depth into its unit increases. The prior art using such mating tongue and groove joints includes: Brown U.S. Pat. No. 3,194,426, granted Jul. 13, 1965, Vom Stein et al. U. S. Pat. No. 3,763,980, granted Oct. 9, 1973, Nagata U. K. 1,539,870, published Feb. 7, 1979 and Moore U. S. Pat. No. 4,624,383, granted Nov. 25, 1986.

SUMMARY OF THE INVENTION

This invention provides a modular unit which may mate with other similar modular units. Mating modules need not be of the same size as for example one unit may be square and a mating unit some other shape such as rectangular. A long rectangular unit may mate with each of several shorter units which in turn may mate with each other. The tongue and groove joints are shaped so that any of the units may be disconnected from any mating unit by moving one of the units either horizontally or vertically away from the unit or units with which it is mating.

Preferably, the units are rectangular (it being noted that "rectangular" is hereby defined to be broad enough to include square) in a horizontal cross-section although they may be any other suitable shape. The tongues on the units, and the grooves in the units, also are rectangular in horizontal cross-section.

The modular units are usually taller than they are wide. Each unit has a solid bottom wall that rests on the floor. The top walls of the units have removable lids with handles as well as tongues and grooves, so that the lids on adjacent units mate with each other. The tongues and grooves of the lids are simply extensions of the tongues and grooves of the body of the receptacle.

There are slots in the receptacle that permit a portion of the receptacle to act as a handle.

DETAILED DESCRIPTION OF THE INVENTION

Figure 1:
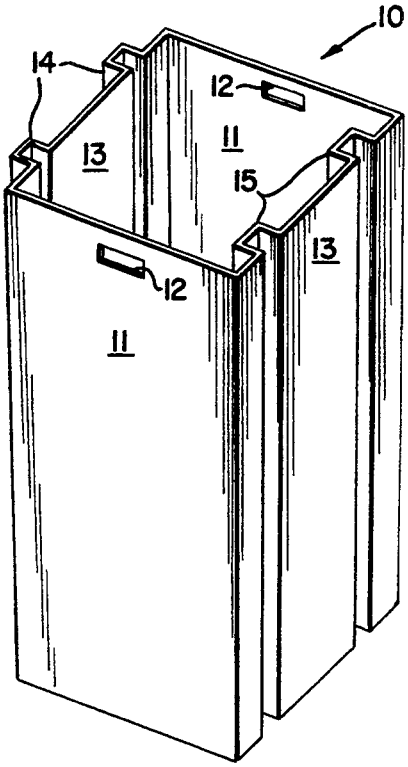
FIG. 1 is a perspective view of one of the modular units without its lid.
Figure 2:
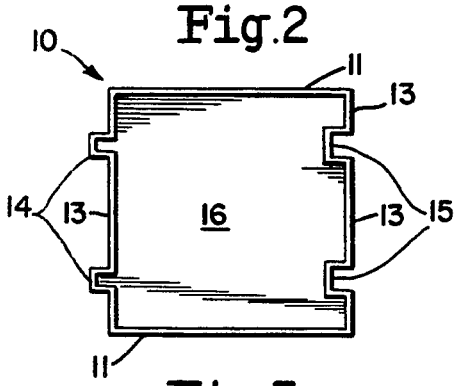
FIG. 2 is a top view of the modular unit of FIG. 1.
Figure 3:
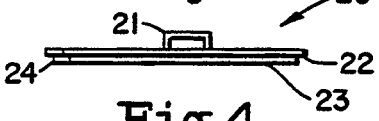
FIG. 3 is a side view of a lid for the modular unit of FIG. 1.
Figure 4:
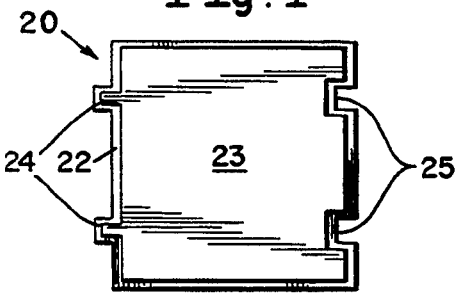
FIG. 4 is a bottom view of the lid of FIG. 3.

FIG. 1 is a modular receptacle 10 which is tall as compared to its width. It has a watertight metal or plastic body that is integral with bottom 16 and with sidewalls 11 and 13. Slots 12 adjacent the upper end of the receptacle enable the portion of the receptacle to comprise a handle—that is a person's hand may grasp the portion. The sidewall 13 has two tongues 14, which will mate with the grooves 15 in the right sidewall 13 of a similar receptacle as will appear. FIG. 3 and 4 show the lid 20 for the receptacle 10. The lid 20 has handle 21, and an upper plate 22 of identical shape as the top of receptacle 10. The lower plate 23 is the same shape as the inner wall of receptacle 10.

Figure 5:
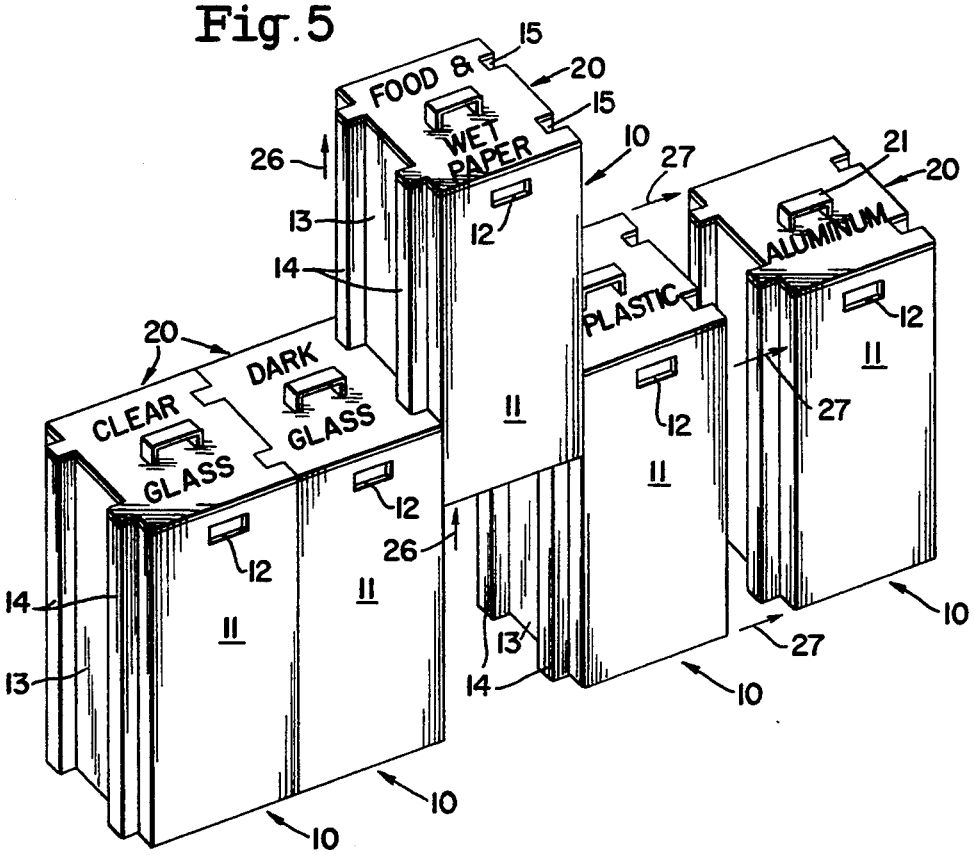
FIG. 5 is an isometric view of a plurality of modular units showing how they fit together.

FIG. 5 shows how a number of receptacles 10 may mate with each other to form a series of trash cans so that trash may be sort and recycled. Each receptacle 10 of FIG. 5 has a lid 20 carrying a label identifying the form of trash to be placed in the receptacle. One advantage of this system is that the tongue and groove joints tend to hold the receptacles in alignment while permitting easy removal of any given receptacle. Assuming that the receptacles are no taller above the floor than the hips of an adult person, any given receptacle may be removed from the others by lifting it vertically or by sliding it horizontally. The handles located above the slots 12 aid in removing a receptacle.

Figure 6:
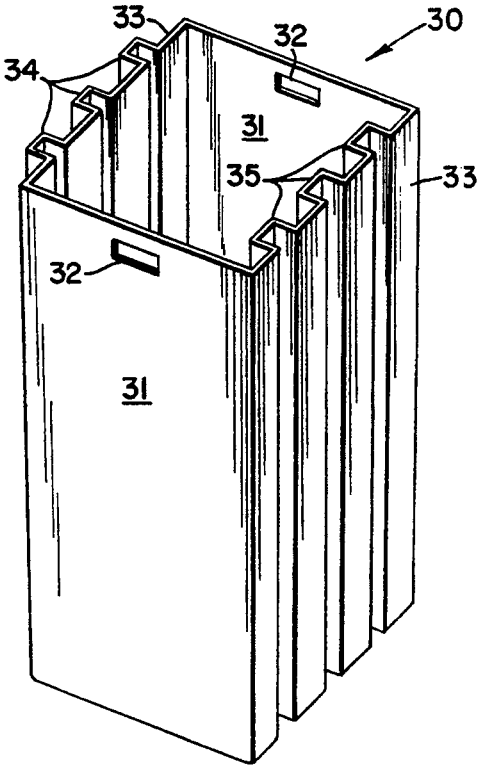
FIG. 6 is a perspective view of a modified form of modular unit having three tongues on one side and three grooves on the other side.
Figure 7:
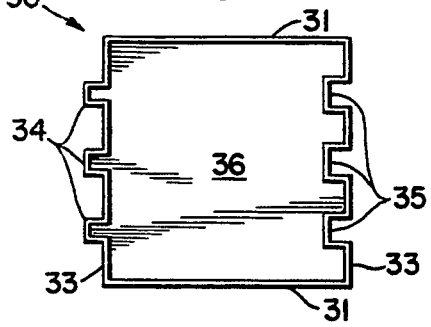
FIG. 7 is a top view of the receptacle of FIG. 6.
Figure 8:
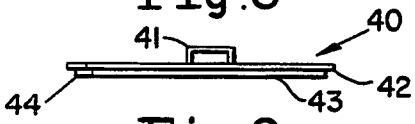
FIG. 8 is a side view of a lid for the receptacle of FIG. 6.
Figure 9:
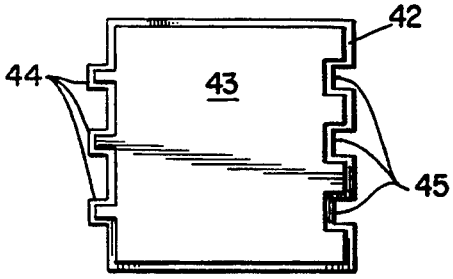
FIG. 9 is a bottom view of the lid of FIG. 8.

FIG. 6 shows a modified form of receptacle 30 having slots 32 near the upper end of sides 31. Tongues 34 enter grooves 35 in a similar receptacle. The bottom 36 rests on the floor. The lid 40 has an upper plate 42 of the same shape as the periphery of the outer surface of receptacle 30 (see FIG. 10) and a lower plate 43 which has the same horizontal cross-section as the inside wall of the receptacle 30. For example, plates 42 and 43 have tongues such as 44 and grooves 45 which will mate with grooves and tongues, respectively, in other similar lids.

Figure 10:
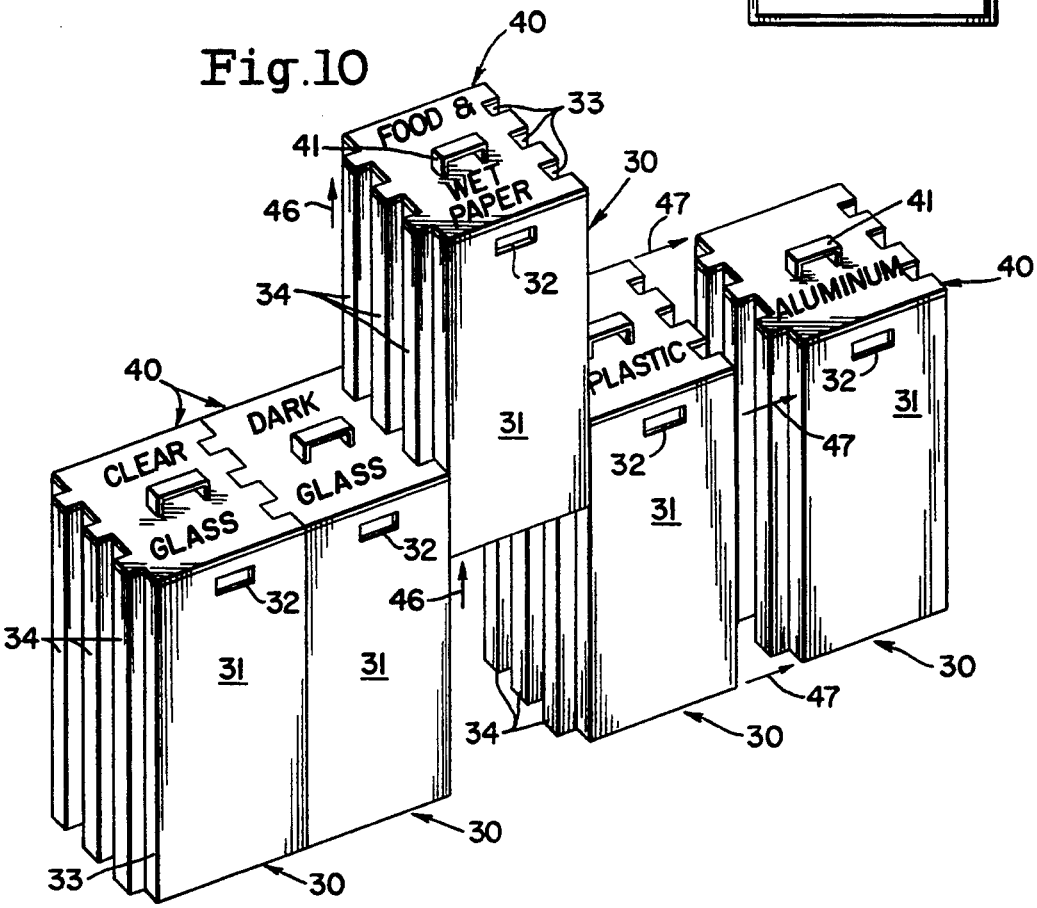
FIG. 10 is an isometric view of plurality of units of the modified form of FIG. 6.

FIG. 10 shows how the receptacles may mate and how any given receptacle may be removed from the others by moving it either horizontally or vertically.

Figure 11:
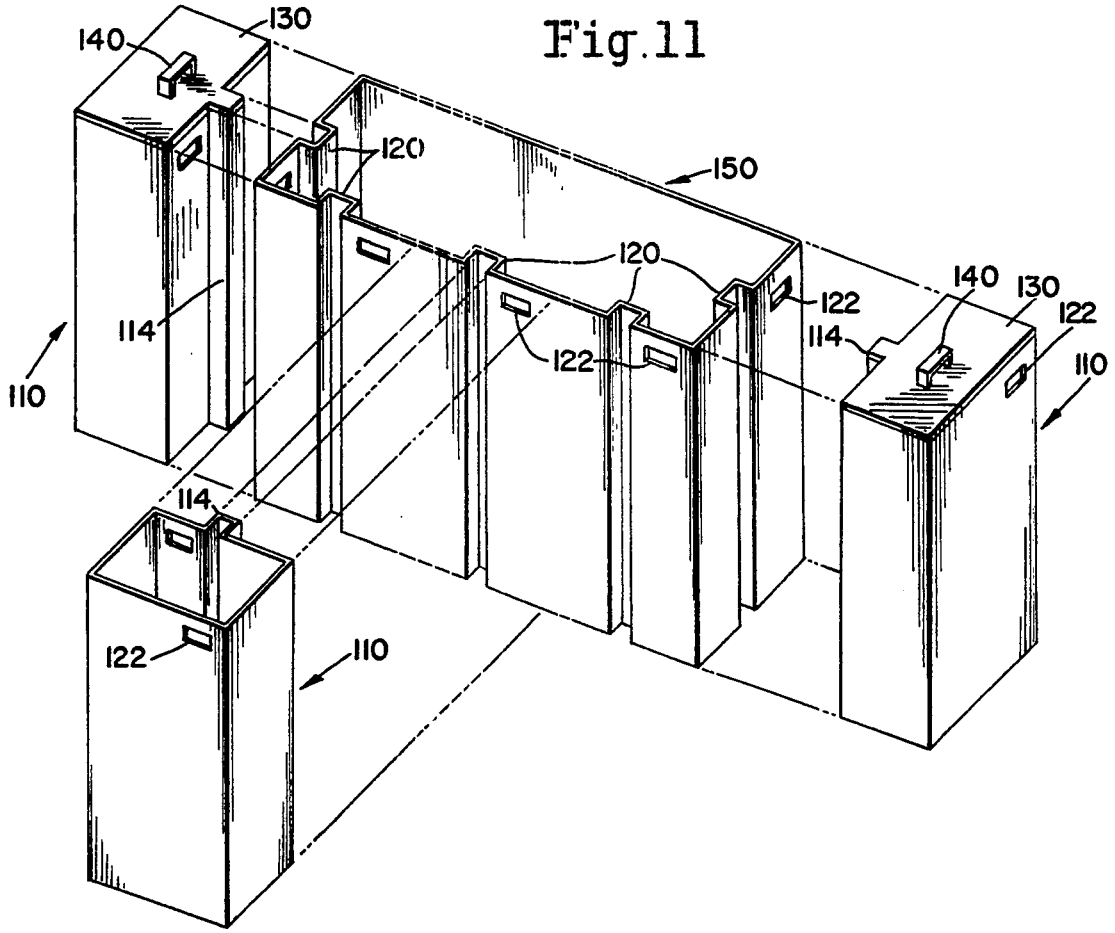
FIG. 11 is an isometric view of a modified form of the invention.

FIG. 11 shows receptacles such as 110, and 150 which have tongues such as 114 and grooves 120. The tongues 114 and grooves 120 mate as shown. The lids 130 are the same shape as the receptacles and have tongues that will mate with grooves in the lids of the central receptacle. There are receptacles 110 that have tongues 114 that enter grooves 120 in end walls of receptacle 150. There is another receptacle 110 that has a tongue 114 that mates with a groove 120 in a sidewall of receptacle 150. The slots 122 form handles out of the portion of the side wall above the slots.

Figure 12:
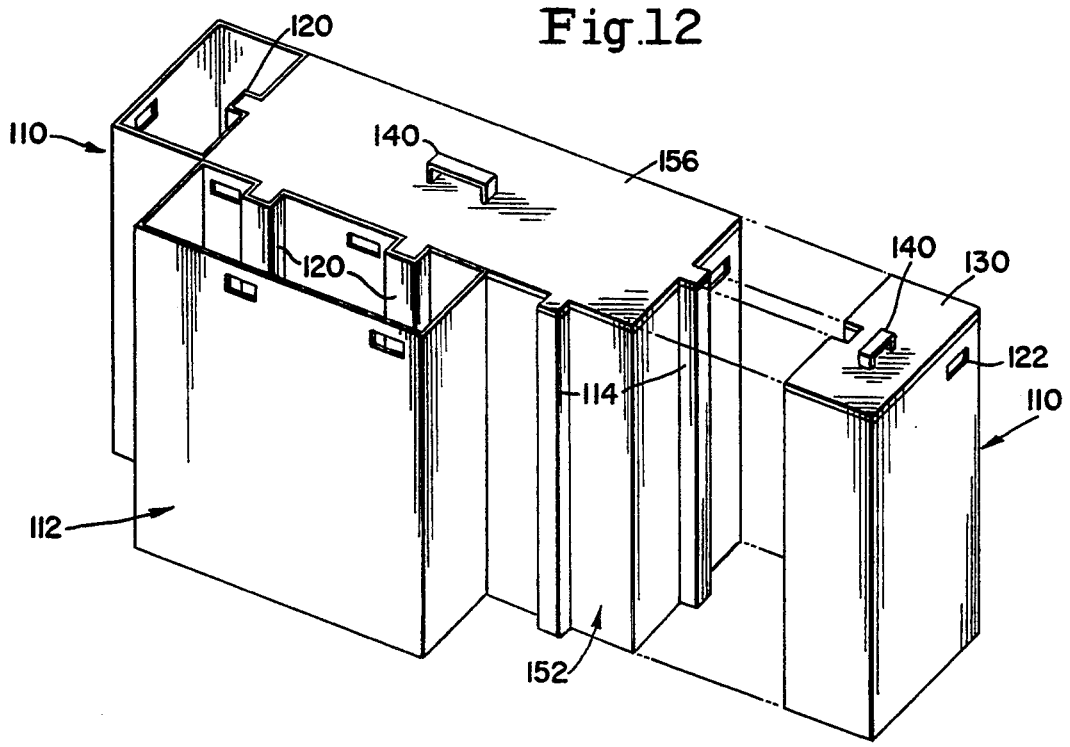
FIG. 12 is an isometric view of modular units in constituting a modified form of the invention.

FIG. 12 shows receptacles 110 (identical with those of FIG. 11), 112 and 152. Lids 156 and 130 have a tongue and a groove, respectively, that mate with each other. The receptacle 152 has tongues 114 that mate with grooves 120 in the other receptacles. The lids have handles 140, and the receptacles 110 have slots 122, which function the same as similar parts in other forms of the invention.

Each of the three groups of receptacles, shown in FIG. 5, 10 and 12, respectively, may be used for sorting trash into its components, so that the trash may be recycled.

Figure 13:
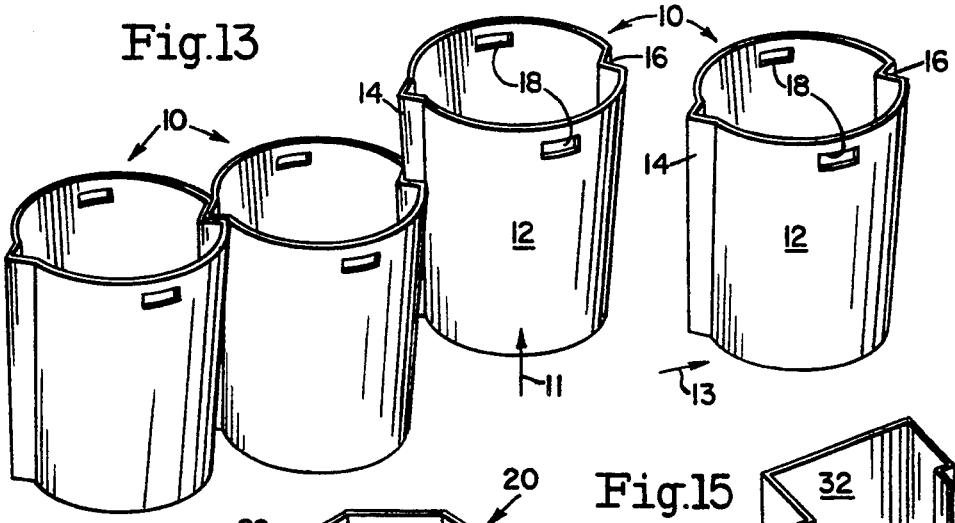
FIG. 13 is a perspective view of a further modified form of the invention.

FIG. 13 illustrates a series of four mating trash cans of round cross-section except that there are tongues and mating grooves of essentially V-shape. Each can of FIG. 13 has slots 18 sufficiently close to the top of the can to permit portions of the can above the slot to be grasped by a human hand so that the can may be lifted from its mating condition and emptied.

Figure 14:
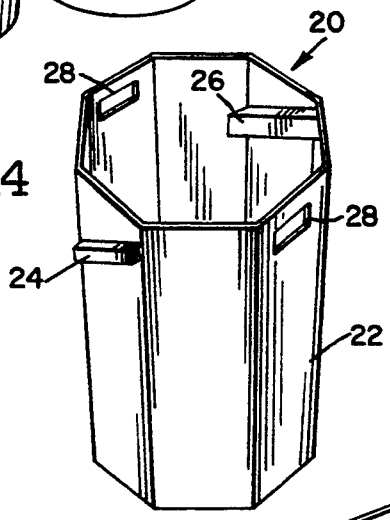
FIG. 14 is a perspective vies of another modified form of the invention.
Figure 15:
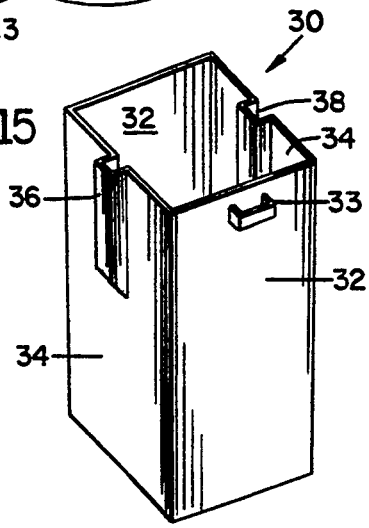
FIG. 15 is a perspective view of still another modified form of the invention.
Figure 16:
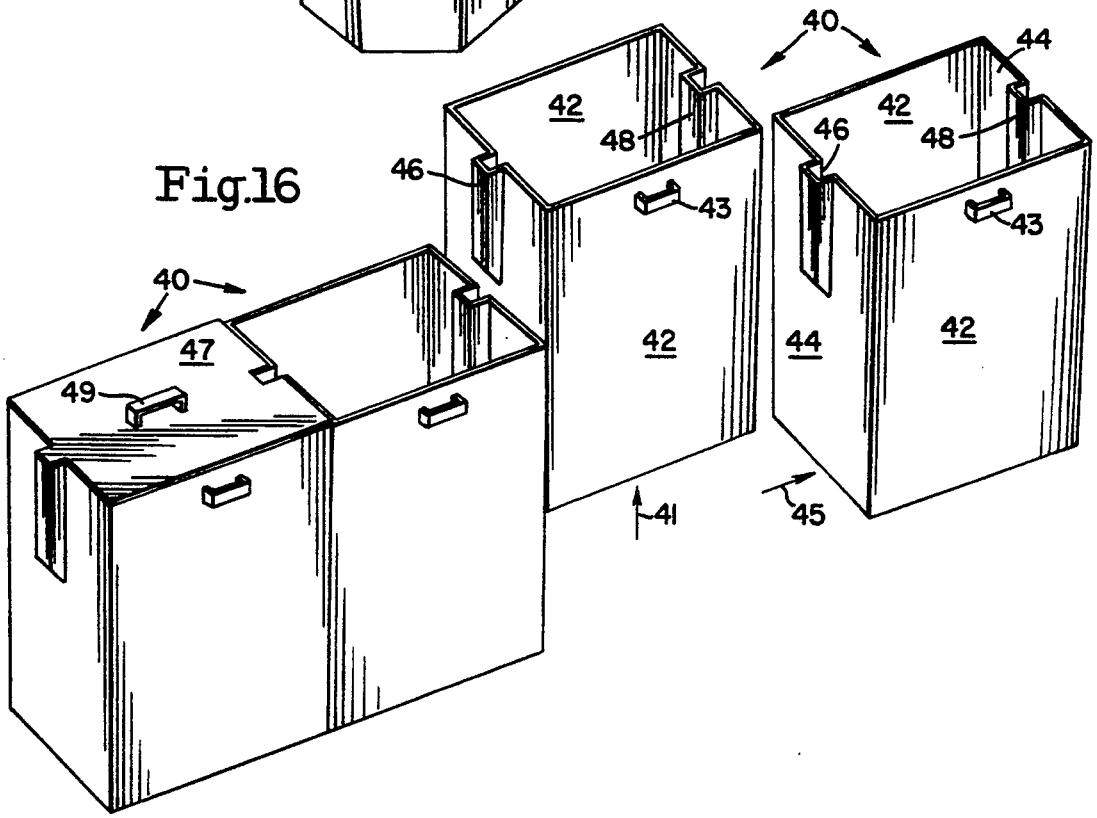
FIG. 16 is a perspective view of a series of trash cans embodying another form of the invention.

In each of FIGS. 14 and 15 only a single trash can is shown but it is contemplated that one or more additional cans of the same configuration will, in actual use, be placed in a meeting relation to the can shown. FIGS. 13 and 16 are examples of such a mating relation.

In FIG. 14 the tongue 24 is at an angle of about 30° to the horizontal and will mate with the groove 26 of a similar can. When such cans are in a mating position they may be disconnected by sliding them horizontally and/or pulling one of them forward at an angle of about 30° to the horizontal. The cans of this figure have slots 28 permitting the can to be gripped as described above.

The can of FIG. 15 has a square or rectangular tongue 36, and a groove 38 that will receive and mate with a tongue 36 of a similar can. The tongue 36 and groove 38 have a length less than half the height of the can. The sidewall may be the same cross-section from top to bottom or the can may have a larger cross-section at its upper end. The cross-section may taper from the bottom to the top of the can. Two handles 38 permit the can to be moved manually. The cans of FIGS. 15 and 16 have their tongues and grooves vertically along the sidewall, near the top, of the can.

The series of trash cans of FIG. 16, has mating tongues 46 and grooves 48. Each can would be provided with a lid 47 which has a tongue that will mate with the groove of an adjacent lid. The vertical tongues 46 and mating grooves 48 on the cans 42 are of short length near the top of the can 42. The cans at each end of the series (FIG. 16) may be removed from the series by sliding them horizontally. The other cans of the series may be removed by sliding the cans apart or by lifting one or more of them vertically.

I claim:

1. A receptacle that will mate with a similar receptacle, comprising:

a hollow body forming said receptacle, said body having a bottom that may rest on a surface such as a floor thus permitting said body to stand upright, said body having a side wall extending upward from said bottom, said side wall having a continuous wall from said bottom to the top of the receptacle as well as around the periphery of the receptacle, said continuous wall including a tongue extending outward from the remainder of said wall and also including, a groove extending inwardly into the receptacle, said tongue and groove being so positioned that the tongue of the receptacle will mate with the groove of another similar receptacle, a lid which has a tongue and groove positioned so that when the lid is on the receptacle the tongue of the lid is aligned with the tongue of the receptacle and the groove in the lid is aligned with the groove of the receptacle.

2. A receptacle as defined in claim 1 in which the portions of the wall forming the tongue and the groove are of substantially the same thickness as the remainder of the wall.

3. A receptacle as defined in claim 1 in which the side wall has a rectangular indent constituting said groove.

4. A receptacle as defined in claim 1 in which said tongue is rectangular.

5. First and second lids for substantially contiguous receptacles comprising:

said first lid having an outer periphery and a tongue extending outwardly of said outer periphery and said second lid having an outer periphery and a groove extending inwardly of said outer periphery and that mates with said tongue, said outer peripheries each having a geometric shape, so that the outer walls of the first and second lids substantially touch each other.

6. First and second lids as defined in claim 5, comprising: each of said lids including means for holding the lid on one of said receptacles when placed thereon.

7. First and second lids as defined in claim 6 in which said means comprises a plate that for mating with an inner side wall of one of said receptacles.

8. A receptacle that will mate with a similar receptacle, comprising:

a hollow body forming said receptacle, said body having a bottom that may rest on a surface such as a floor thus permitting said body to stand upright, said body having a sidewall extending upward from said bottom, said body being taller than the maximum linear dimension of a cross-section of said bottom, said sidewall having a continuous wall from said bottom to the top of the receptacle as well as around the periphery of the receptacle, said continuous wall including a tongue extending outward from said wall and also including, a groove extending upwardly and also into the receptacle.

said tongue and groove being so positioned that the tongue of a receptacle will mate with the groove of another similar receptacle, and, comprising means for enabling the tongue of one receptacle to mate with the groove of a similar receptacle by bringing the receptacles together in either of two different plane, and handle means enabling at least one human hand to pass through said mean to lift the receptacle vertically.

9. A receptacle as defined in claim 8, in which the portions of the wall forming the tongue and groove are of substantially the same thickness as the remainder of the wall.

10. A receptacle as defined in claim 8 in which said tongue extends at an acute angle to the bottom.

11. A receptacle as defined in claim 8 in which said tongue has a generally tapering cross-section in which the cross-section of the tongue at said sidewall is greater than it is at a portion spaced from said sidewall.

12. A receptacle as defined in claim 8 in which said tongue has V-shaped cross-section.

13. A receptacle as defined in claim 8 in Which said sidewall defines a slot therein and near the top thereof to thereby form said handle means.

14. A receptacle that will mate with a similar receptacle, comprising:

a hollow body forming said receptacle, said body having a bottom that may rest on a surface such as a floor thus permitting said body to stand upright, said body having a sidewall extending upward from said bottom, said body being taller than the maximum linear dimension of a cross-section of said bottom, said sidewall having a continuous wall from said bottom to the top of the receptacle as well as around the periphery of the receptacle, said continuous wall including a tongue extending outward from said wall and also including, a groove extending upwardly and also into the hollow body, said tongue and groove being so positioned that the tongue of a receptacle will mate with the groove of another similar receptacle, and, comprising means for enabling the tongue of one receptacle to mate with the groove of a similar receptacle by bringing the receptacles together in either of two different planes, said tongue having a length that is less than half the height of the receptacle.

* * * * *